United States Patent [19]

Flanagan

[11] 4,266,991

[45] May 12, 1981

[54] CHLORINEFLUORIDE SOLID GAS GENERATOR

[75] Inventor: Joseph E. Flanagan, Woodland Hills, Calif.

[73] Assignee: Rockwell International Corporation, El Segundo, Calif.

[21] Appl. No.: 57,463

[22] Filed: Jul. 13, 1979

[51] Int. Cl.[3] ..... C06B 33/06

[52] U.S. Cl. ..... 149/42; 149/77

[58] Field of Search ..... 149/42, 77

[56] References Cited

U.S. PATENT DOCUMENTS 4,003,771 1/1977 Lubowitz ..... 149/17

*Primary Examiner*—Stephen J. Lechert, Jr.

*Attorney, Agent, or Firm*—H. F. Hamann; Harry B. Field

[57] ABSTRACT

A solid propellant gas generator comprising alkali chlorides, potassium fluorochlorinate, and aluminum which produces pure chlorinefluoride gas in the absence of other gaseous products.

5 Claims, No Drawings

CHLORINEFLUORIDE SOLID GAS GENERATOR

BACKGROUND OF THE INVENTION

1. Field of the Invention

This invention relates to gas generators and is particularly directed to solid propellant gas generators for producing pure chlorinefluoride (ClF) gas in the absence of other gaseous products.

2. Description of the Prior Art

A multitude of solid propellant gas generators exist which are capable of producing mixtures of nitrogen trifluoride ($NF_3$) and fluorine ($F_2$) gases for the operation of continuous wavelength chemical DF or HF chemical lasers. These gas generators are all based upon a variety of $NF_4^+$ salts such as $NF_4BF_4$.

Recent developments in the pulsed operation of chemical lasers indicate that higher efficiencies can be achieved if chlorinefluoride (ClF) gas is employed. The presence of $NF_3$degrades the performance which eliminates the systems based upon the $NF_4^+$ salts from consideration.

U.S. Pat. No. 4,003,771 describes a gas generator based upon potassium fluorochlorinate ($KClF_4$) for use in chemical lasers. However, the gases produced from the systems described would yield a mixture of $ClF_3$, ClF, $F_2$, and $Cl_2$ gases which would not lead to satisfactory pulsed laser performance.

SUMMARY OF THE INVENTION

Accordingly, there is provided by the present invention a solid propellant gas generator for producing pure chlorinefluoride gas in the absence of other gaseous products.

OBJECTS OF THE INVENTION

Therefore, it is an object of the present invention to provide solid propellant gas generators comprising a mixture of alkali chlorides, potassium fluorochlorinate, and aluminum.

Another object of the present invention is to provide a chlorinefluoride gas generator.

Yet another object of the present invention is to provide a solid propellant gas generator yielding chlorinefluoride gas in the absence of other gaseous products.

Other objects, advantages, and novel features of the present invention will become apparent from the following detailed description of the invention.

DESCRIPTION OF THE PREFERRED EMBODIMENTS

In accordance with the present invention, a solid propellant chlorinefluoride gas generator is provided comprising a stoichiometrically-balanced mixture of alkali chlorides, potassium fluorochlorinate, and aluminum.

Potassium fluorochlorinate ($KClF_4$) is the preferred oxidizing source and was chosen for its excellent thermal stability. Alkali chlorides or mixtures of various alkali chlorides must be present to supply the chlorine necessary to stoichiometrically balance the excess fluorine present in the $KClF_4$. Small percentages of aluminum are added as the combustion fuel. The overall reaction can be represented by the equation:

$$X_1KClF_4 + X_2Al + X_3MCl \rightarrow$$

-continued $$\underbrace{X_2(M_3AlF_6) + (X_1 + X_3 - 3X_2)MF}_{\text{Solid residue}} + (X_1 + X_3)\,ClF\uparrow$$

where M is preferably potassium, sodium, lithium, or mixtures thereof, and most preferably potassium; and $X_{1\text{-}3}$ are the molar reaction coefficients. The moles of alkali chloride ($X_3$) required to assure the production of pure ClF are determined from the equation:

$$X_3 = X_1 - 1.5X_2$$

The temperature of the ClF produced is controlled by moles of aluminum fuel ($X_2$) present in the composition. Care must be exercised to maintain the reaction temperature below the dissociation temperature of ClF, and in the case where M is lithium that the dissociation temperature of lithiumfluoroaluminate ($Li_3AlF_6$) is not exceeded.

When mixtures of alkali chlorides are used in the gas generator propellants appropriate stoichiometric calculations will readily yield optimum molar percentages.

By way of illustration and not limitation, specific examples of typical compositions are given in Table 1.

TABLE 1

| Ingredient | Weight Percent | | | |
|---|---|---|---|---|
| $KClF_4$ | 69.50 | 72.33 | 75.40 | 74.19 |
| Al | 1.25 | 2.60 | 4.06 | 1.33 |
| KCl | 29.25 | 25.07 | 20.54 | — |
| NaCl | — | — | — | 24.48 |
| Reaction Temperature (°K.) | 654 | 1195 | 1640 | 795 |
| Weight Yield of ClF | 46.3 | 43.9 | 38.5 | 49.4 |

The yield of ClF is improved at the same aluminum level as the molecular weight of the alkali chloride utilized is reduced.

Obviously, many modifications and variations of the present invention are possible in light of the above teachings. It is, therefore, to be understood that, within the scope of the appended claims, the invention may be practiced otherwise than as specifically described.

What is claimed and desired to be secured by Letters Patent of the United States is:

1. A stoichiometrically-balanced solid propellant chlorinefluoride gas generator, which comprises:

an alkali chloride or mixtures of alkali chlorides, as the primary source of chlorine;

potassium fluorochlorinate oxidizer; and aluminum fuel.

2. The solid propellant of claim 1 wherein said alkali chlorides are selected from the group consisting of potassium chloride, sodium chloride, lithium chloride, and mixtures thereof.

3. The solid propellant of claim 2 wherein said alkali chloride is potassium chloride.

4. The solid propellant of claim 1 wherein said stoichiometrically balanced solid propellant chlorinefluoride gas generator comprises:

$$X_1KClF_4 + X_2AL + X_3MCl$$

which upon combustion yields $X_2(M_3AlF_6) + (X_1 + X_3 - 3X_2)MF + (X_1 + X_3)$ ClF↑ and wherein M is selected from the group consisting of potassium, sodium, lithium or mixtures thereof, and wherein $X_1$, $X_2$, and $X_3$ are molar reaction coefficients wherein $X_3 = X_1 1.5X_2$.

5. The solid propellant of claim 4 comprising from about 69 to about 76 weight percent $KClF_4$, from about 1 to about 5 weight percent aluminum, and from about 20 to about 30 weight percent of MCl.

* * * * *

UNITED STATES PATENT AND TRADEMARK OFFICE

CERTIFICATE OF CORRECTION

PATENT NO. : 4,266,991

DATED : May 12, 1981

INVENTOR(S) : Joseph E. Flanagan

It is certified that error appears in the above-identified patent and that said Letters Patent are hereby corrected as shown below:

Column 2, line 57, delete "$X_1KClF_4+X_2AL+X_3MCl$" and insert therefor --$X_1KClF_4 + X_2Al + X_3MCl$--.

Column 2, line 63, delete "$X_3 = X_1 1.5X_2$" and insert --$X_3 = X_1 - 1.5X_2$--.

Signed and Sealed this

*Eighteenth* Day of *August 1981*

[SEAL]

*Attest:*

GERALD J. MOSSINGHOFF

*Attesting Officer*

*Commissioner of Patents and Trademarks*